US006560434B2

(12) United States Patent
Chapman et al.

(10) Patent No.: US 6,560,434 B2
(45) Date of Patent: May 6, 2003

(54) INTERMEDIATE TRANSFER MEMBER MOTION CONTROL VIA SURFACE WHEEL FEEDBACK

(75) Inventors: Danny Keith Chapman, Nicholasville, KY (US); Brian Anthony Reichert, Lexington, KY (US); John Parker Richey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 10 days.

(21) Appl. No.: 09/764,368

(22) Filed: Jan. 18, 2001

(65) Prior Publication Data

US 2002/0122678 A1 Sep. 5, 2002

(51) Int. Cl.[7] ..... G03G 15/16
(52) U.S. Cl. ..... 399/302; 399/308
(58) Field of Search ..... 399/302, 303, 399/308, 312

(56) References Cited

U.S. PATENT DOCUMENTS

| | | | | |
|---|---|---|---|---|
| 3,906,897 | A | | 9/1975 | Davidson |
| 3,998,184 | A | | 12/1976 | Hudson |
| 4,710,016 | A | | 12/1987 | Waatanabe |
| 4,723,145 | A | | 2/1988 | Takada et al. |
| 4,739,230 | A | | 4/1988 | Sonobe et al. |
| 4,754,301 | A | | 6/1988 | Kasamura et al. |
| 4,801,966 | A | | 1/1989 | Ikeda |
| 4,847,660 | A | | 7/1989 | Wheatley, Jr. et al. |
| 4,860,053 | A | | 8/1989 | Yamamoto et al. |
| 4,882,778 | A | | 11/1989 | Hosaka et al. |
| 4,887,101 | A | | 12/1989 | Hirose et al. |
| 4,888,621 | A | | 12/1989 | Ohno |
| 4,891,672 | A | | 1/1990 | Takagi |
| 4,914,777 | A | | 4/1990 | Cartellone |
| 4,928,144 | A | | 5/1990 | Kasabara et al. |
| 4,937,664 | A | | 6/1990 | Chiku et al. |
| 4,939,547 | A | | 7/1990 | Miyaji et al. |
| 4,941,018 | A | | 7/1990 | Kasamura et al. |
| 4,970,561 | A | | 11/1990 | Mizuno |
| 5,006,899 | A | | 4/1991 | Bujese |
| 5,103,764 | A | | 4/1992 | Fujiwara et al. |
| 5,132,733 | A | | 7/1992 | Koizumi et al. |
| 5,138,398 | A | | 8/1992 | Yamada |
| 5,172,175 | A | | 12/1992 | Sekino et al. |
| 5,185,628 | A | * | 2/1993 | Wilson et al. ..... 399/81 |
| 5,233,402 | A | | 8/1993 | Yagi et al. |
| 5,235,392 | A | | 8/1993 | Hediger |
| 5,272,492 | A | | 12/1993 | Castelli |
| 5,283,613 | A | | 2/1994 | Midgley, Sr. |
| 5,303,018 | A | | 4/1994 | Terada et al. |
| 5,381,167 | A | | 1/1995 | Fujii et al. |
| 5,420,676 | A | | 5/1995 | Arcaro |
| 5,424,763 | A | | 6/1995 | Komiya et al. |
| 5,444,525 | A | | 8/1995 | Takahashi et al. |
| 5,471,314 | A | | 11/1995 | Orlicki et al. |

(List continued on next page.)

FOREIGN PATENT DOCUMENTS

| | | | |
|---|---|---|---|
| JP | 10-133517 | * | 5/1998 |
| JP | 11-202576 | * | 7/1999 |

*Primary Examiner*—Quana M. Grainger
(74) *Attorney, Agent, or Firm*—Dinsmore & Shohl LLP

(57) ABSTRACT

A motion control system for controlling the motion of an intermediate transfer member in an image forming apparatus is provided in which a measuring member directly contacts the intermediate transfer member and generates signals proportional to the surface motion of the member. The measured surface motion is provided as a feedback signal to a motor controller, which compares the feedback signal with a reference signal. The difference between the signals is used to adjust the control of the drive motor for the intermediate transfer member drive roller in order to maintain a constant velocity for the intermediate transfer member.

32 Claims, 8 Drawing Sheets

U.S. PATENT DOCUMENTS 5,486,902 A 1/1996 Ito
5,493,385 A 2/1996 Ng
5,508,789 A 4/1996 Castelli et al.
5,512,984 A 4/1996 Kimura et al.
5,537,197 A 7/1996 Fujishiro et al.
5,585,898 A 12/1996 Fujii
5,649,265 A 7/1997 Tabuchi
5,652,075 A 7/1997 Kanbayashi et al.
5,678,150 A 10/1997 Takahashi et al.
5,732,306 A 3/1998 Wilczak, Jr.
5,765,082 A 6/1998 Numazu et al.
5,802,422 A 9/1998 Hokari
5,819,149 A 10/1998 Watanabe et al.
5,828,934 A 10/1998 Tamura et al.
5,875,380 A 2/1999 Iwata et al.
5,881,346 A * 3/1999 Mori et al. ..... 399/301
5,893,017 A 4/1999 Yamamoto
5,907,741 A 5/1999 Matsuzawa et al.
5,930,553 A 7/1999 Hirst et al.
5,946,537 A 8/1999 Nakayasu et al.
5,950,051 A * 9/1999 Casella ..... 399/164
5,995,717 A 11/1999 Tanaka
5,995,802 A 11/1999 Mori et al.
6,198,889 B1 * 3/2001 Yu et al. ..... 399/75

* cited by examiner

INTERMEDIATE TRANSFER MEMBER MOTION CONTROL VIA SURFACE WHEEL FEEDBACK

TECHNICAL FIELD

The present invention relates generally to an image forming apparatus, and more particularly, to a control system and method for an intermediate transfer member of an image forming apparatus in which a surface wheel and attached encoder is used to directly measure and control the motion quality of the transfer member.

BACKGROUND OF THE INVENTION

Color electrophotographic (EP) printers are commonly utilized to form an image on a recording sheet or other tangible medium. In color electrophotography, an image is created on the surface of an imaging member composed of a photoconducting material, by first uniformly charging the surface, and then selectively exposing areas of the surface to a light beam. A difference in electrostatic charge density is created between those areas on the surface which are exposed to the light and those areas that are not exposed to the light. The latent electrostatic image is developed into a visible image by electrostatic toners, which are selectively attracted to either the exposed or unexposed portions of the photoconductor surface, depending on the relative electrostatic charges on the photoconductor surface, the development electrode and the toner. Toners of various colors may be applied to the electrostatic images in order to produce different color planes. After toning, each color plane is transferred to a transfer media, at an image transfer station.

Color EP printers are typically one of two types. The first type of printer is a revolver type in which a transfer media makes multiple passes past a single image transfer station, receiving a separate color plane from the imaging member during each pass. Alternatively, the printer may be of the tandem type, in which a transfer media makes a single pass by multiple image transfer stations, accumulating and superposing color planes from each station during the pass. Both types of printers include an intermediate transfer member (ITM), such as a transfer belt, which may serve as the transfer media. Color planes from each of the transfer stations may be accumulated on the transfer belt with a subsequent, single transfer to a tangible media, such as paper. Alternatively, the transfer belt may be used to transport a paper sheet or other tangible media past the image transfer station(s), so that the color planes are accumulated directly on the paper.

Because color tandem EP printers superpose color planes from multiple transfer stations to form a single, multi-color image, they are susceptible to print quality defects that arise from misregistration of the color planes that are successively deposited on the accumulating media. In order to reduce the misregistration errors due to the color planes being transferred at different spatial positions, each of the transfer station positions must be known or predicted with great precision (e.g., <50 um), so that successive color planes can be registered acceptably for print quality. However, many sources of error are inherent in an ITM mechanical subassembly that can create errors of 50 um or more. For instance, when an ITM belt is driven by a constant speed motor at one of a plurality of belt rollers, belt velocity errors may arise from: 1) runout of the drive roller, 2) belt thickness variations (which affect the effective diameter of the drive roller), and/or 3) tension variations in the belt (which may be different at each color plane transfer point). The integration of belt velocity between color transfer stations determines the position error. Other position errors may also arise independent of velocity and relate to the path followed by a belt of varying thickness over rollers that have varying amounts of runout.

A number of attempts have been made to characterize the ITM mechanical subassembly during the run-in or calibration cycle of the printer itself, in order to reduce misregistration between the color planes. These characterization attempts have included generating and transferring a test pattern from each imaging member onto the belt, using a complex sensor to detect the test pattern position on the belt to an accuracy of better than 50 um, and correcting the belt speed or position based upon the internal calibration. While these characterization procedures have reduced misregistration errors, and thereby improved print quality, such processes are costly, waste toner, consume machine time at each calibration (e.g. 2 minutes), and add significant complexity to the machine.

In a color EP machine, the ITM belt is typically driven by a motor shaft, which rotates a drive roller through a gear reduction. To control the speed of the drive roller, and thus the velocity of the transfer belt, prior motion control systems have relied upon feedback coming directly from the motor shaft to control the drive motor. However, depending upon the quality of the gear reduction and the quality of the drive roller, the feedback from the motor shaft may not accurately represent the true velocity or position of the transfer belt. Thus, even with the motor shaft feedback, the resulting motion quality of the ITM may be relatively poor. The poor motion quality of the ITM can result in poor color plane registration and poor overall print quality.

Accordingly, to reduce misregistration errors between superposed color planes and improve print quality, it is desirable to have a motion quality control system for an ITM that accurately reflects the true motion of the ITM belt. Further, it is desirable to have such a motion quality control system that eliminates errors associated with drive roller eccentricities, transfer belt thickness variations, and other velocity/position signatures of the belt subassembly without the complexity, time and toner waste associated with characterization procedures.

SUMMARY OF THE INVENTION

Accordingly, it is an object of the present invention to provide an improved motion quality control for an intermediate transfer member in an image forming apparatus.

In particular, it is a primary object of the present invention to provide a system and method for controlling the velocity of an intermediate transfer member in a printer, in which the surface motion of the transfer member is directly measured and fed back to a transfer member drive motor in order to maintain a constant velocity for the transfer member. By directly measuring the surface motion of the intermediate transfer member, and providing the measured motion as a feedback signal to the intermediate transfer member drive motor, the drive motor is able to react directly to changes in the surface motion of the transfer member belt. Thus, a constant velocity may be maintained for the intermediate transfer member without the need to characterize the transfer belt during the run-in or calibration cycle of the printer.

To achieve the foregoing and other objects, and in accordance with a first aspect of the present invention, a motion control system for controlling the motion of an intermediate transfer member in an image forming apparatus is provided in which a measuring member directly measures the surface motion of the intermediate transfer member and generates signals proportional to the velocity of the member. The measured surface motion is provided as a feedback signal to a motor controller, which compares the signal with a reference signal. The difference between the signals is used to adjust the control of a drive motor for the intermediate transfer member drive roller in order to maintain a constant velocity for the intermediate transfer member.

In accordance with a second aspect of the present invention, a method of controlling the motion of an intermediate transfer member in an image forming apparatus is provided which includes the steps of directly measuring the surface motion of the intermediate transfer member, providing the measured surface motion as a feedback signal to a motor controller for the intermediate transfer member, and adjusting the velocity of the intermediate transfer member in accordance with the feedback signal.

In accordance with a third aspect of the present invention, a color image forming apparatus for forming an image by superposing a plurality of color planes on a transfer media is provided which includes one or more image forming members for forming a plurality of different color toner images and an intermediate transfer member for receiving each of the different color toner images at a transfer point. A drive member rotates the intermediate transfer member, while the surface motion of the member is directly measured by a measuring member. The measured surface motion is provided as a feedback signal to a controller for the drive motor of the intermediate transfer member drive roller, in order to control the velocity of the intermediate transfer member in accordance with the measured motion.

Still other objects and advantages of the present invention will become apparent to those skilled in this art from the following description and drawings, wherein there is described and shown a preferred embodiment of this invention in one of the best modes contemplated for carrying out the invention. As will be realized, the invention is capable of other different embodiments, and its several details are capable of modification in various, obvious aspects all without departing from the scope of the invention. Accordingly, the drawings and descriptions will be regarded as illustrative in nature and not as restrictive.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views. As will be appreciated, the present invention, in its most preferred form, is directed to a motion control system for an intermediate transfer member (ITM) in an image forming apparatus, in which the motion of the transfer member is directly measured and provided as a feedback signal to the transfer member drive motor controller to enable the motor to drive the member at a constant velocity.

Figure 1:
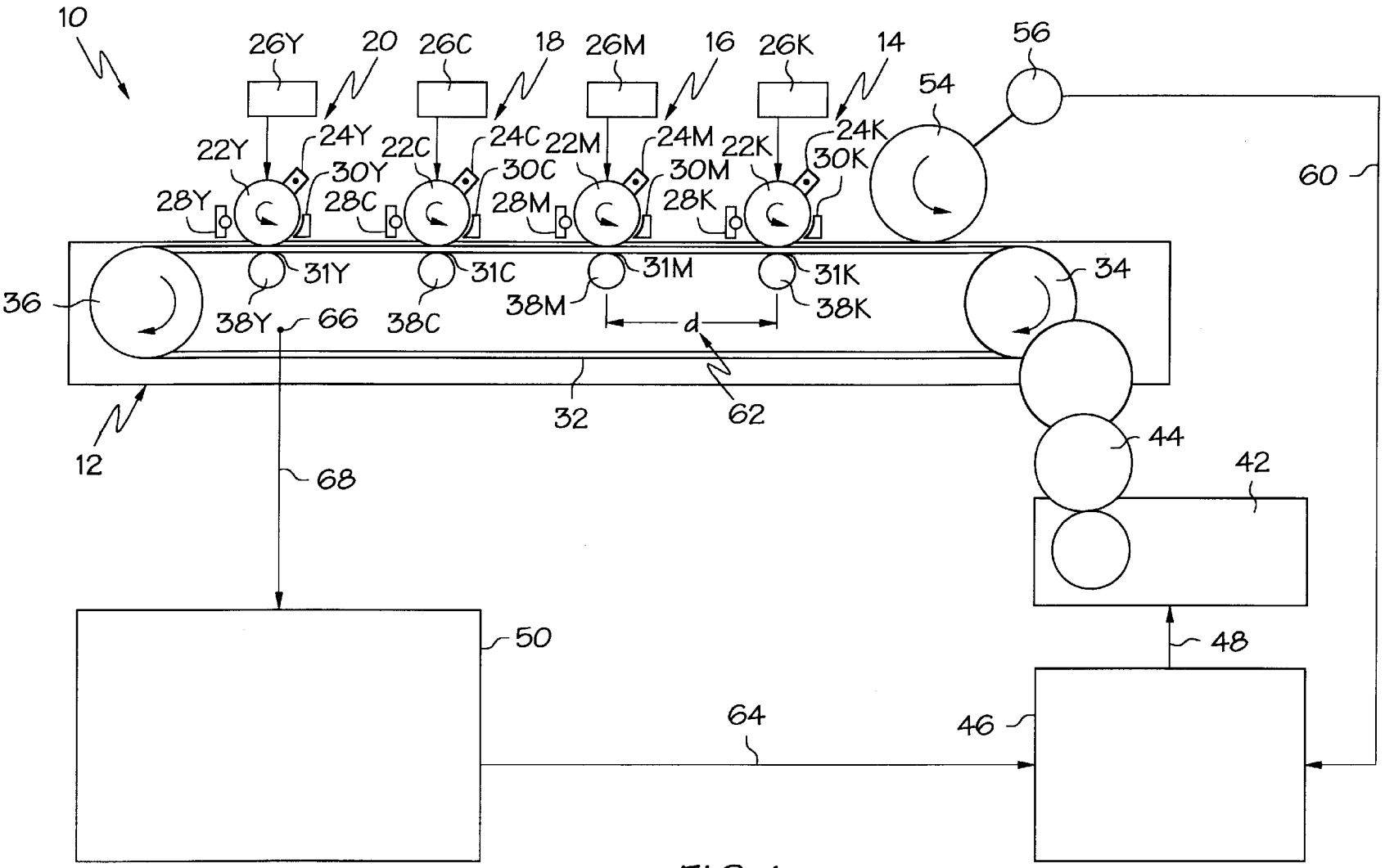
FIG. 1 is a simplified schematic diagram of an image forming apparatus including the motion control system of the present invention.

Referring now to the drawings, FIG. 1 illustrates an exemplary color image forming apparatus 10 in accordance with the present invention. The present invention is particularly suited to, and will be described in conjunction with, a tandem type color printing apparatus, in which separate color planes are transferred to an ITM at different spatial positions. The color planes may be transferred to and superposed on the ITM itself, in which case the member serves as the transfer media. The resulting superposed color image is then subsequently transferred to a paper sheet or other tangible medium. Alternatively, a paper sheet or other tangible medium may be placed on the ITM by paper supply and register rollers (not shown), so that the color planes are transferred to and superposed directly on the paper.

As shown in FIG. 1, the image forming apparatus 10 includes a plurality of image forming members arranged serially along an ITM subassembly 12. Preferably, the image forming members are arranged so that member 14 forms a black toner image, member 16 a magenta toner image, member 18 a cyan toner image, and member 20 a yellow toner image respectively. The image forming member 20 comprises a photoconductive drum 22Y, a charger 24Y, an optical writing unit 26Y, a developing unit 28Y, and a cleaning unit 30Y. The charger 24Y charges the photoconductive drum 22Y so that an electrostatic latent image is formed on the drum by the optical writing unit 26Y. The developing unit 28Y develops the latent image as a yellow toner image. The yellow toner image is transferred to a transfer media at transfer point 31Y. After the image is transferred, the cleaning unit 30Y removes any toner remaining on the photoconductive drum 22Y. Similarly, the image forming member 18 comprises a photoconductive drum 22C, a charger 24C, an optical writing unit 26C, a developing unit 28C, a transfer point 31C, and a cleaning unit 30C. The image forming member 16 comprises a photoconductive drum 22M, a charger 24M, an optical writing unit 26M, a developing unit 28M, a transfer point 31M, and a cleaning unit 30M. The image forming member 14 comprises a photoconductive drum 22K, a charger 24K, an optical writing unit 26K, a developing unit 28K, a transfer point 31K, and a cleaning unit 30K.

The ITM subassembly 12 includes an endless transfer belt 32 supported between a drive roller 34 and an idle roller 36. Transfer belt 32 is drivingly engaged with the drive roller 34 to rotate continuously about the subassembly 12, past each of the image transfer points 31Y, 31C, 31M, and 31K. Transfer rollers 38Y, 38C, 38M and 38K are positioned along the transfer belt 32, opposite each of the image forming members 20, 18, 16 and 14, to provide for transfer of each color plane from the respective photoconductive drum to the transfer media. The transfer belt 32 may serve as the transfer media when color planes are superposed directly on the ITM belt.

In the above-described image forming apparatus 10, the yellow toner image is transferred by the image forming member 20 in synchronization with the conveyance of the transfer belt 32. Following transfer, the media containing the yellow toner image is conveyed to a position corresponding to the image transfer point 31C. Then, a cyan toner image is transferred and superimposed on the yellow toner image by the image forming unit 18. Similarly, a magenta toner image is transferred and superimposed on the cyan toner image at transfer point 31M, and a black toner image is transferred and superposed on the previous images at transfer point 31K. Accordingly, a multi-color or full-color image is formed by the superimposingly transferred yellow, cyan, magenta and black toner images. The multi-color image is then affixed on the paper sheet by being passed through a fixing unit (not shown), or is transferred from the belt to a paper sheet and then affixed to the paper sheet.

As mentioned above, transfer belt 32 is conveyed in an endless loop by drive roller 34. Drive roller 34 is in turn rotated by a drive motor 42 through a gear reduction 44 having a reduction ratio appropriate to the application. In the exemplary embodiment, drive motor 42 is a brushless DC (BLDC) motor. However, other types of motors may also be utilized for drive motor 42 without departing from the scope of the invention, such as, for example a brush DC or stepper motor. In addition, other types of rotation transmitting systems may be utilized in conjunction with the present invention, depending upon the application, without departing from the scope of the invention.

As shown in FIG. 1, a motor controller 46 is also provided for controlling the speed of the drive motor 42, as indicated by arrow 48. Motor controller 46 controls the drive motor 42 based in part on signals received from the EP print machine controller 50. Machine controller 50 preferably includes a microprocessor programmed to control the operation of the image forming apparatus 10.

In the ITM subassembly 12 described above, the endless transfer belt 32 is driven by the drive roller 34 so as to rotate in a continuous loop about the drive roller 34 and idle roller 36. Because the transfer belt 32 is driven in this manner about the rollers 34, 36, the speed of the transfer belt periodically fluctuates due to unavoidable eccentricities in the drive roller, idle roller, and gear reduction 44. When these periodic fluctuations occur in the speed of the transfer belt 32, the positions of the images transferred at each of the points 31Y, 31C, 31M and 31K may be slightly offset from the ideal position, resulting in misregistration between the superposed images.

To take into account the various eccentricities in the ITM subassembly, and prevent misregistration between superposed images, the motion of the transfer belt 32 is more accurately measured and maintained in the present invention by directly measuring the motion of the ITM at the surface of the belt. The measured surface motion is then used to control the drive roller motor 42. To measure motion along the surface of the belt 32, a measuring member is mounted along the pathway of the belt to detect the surface motion and generate a feedback signal proportional to the motion. In the preferred embodiment, the measuring member is a wheel 54 that is mounted along the pathway of the belt, such that the circumference of the wheel contacts the surface of the belt. The wheel 54 is mounted to the ITM subassembly 12 such that the circumference of the wheel rides on the surface of transfer belt 32 sufficiently for the belt to rotate the wheel, but without the wheel interfering with the motion of the belt. The wheel 54 may be comprised of any suitable material depending upon the application, such as, for example, aluminum, as used in the exemplary embodiment.

As indicated in FIG. 1, an encoder 56 is mounted to the wheel 54 to rotate along with the wheel and measure the rotation. The encoder 56 is preferably an optical encoder such as, for example, Gurly Precision Instruments Model 9111S-01800F, or another similar device, that generates a series of pulses as the encoder rotates with the wheel 54. As encoder 56 rotates, it generates a pulse stream that is proportional to the speed of the transfer belt 32. The number of lines or pulses produced per revolution of the encoder 56 may vary depending upon the particular application, but is preferably high enough to provide sufficient feedback to correct for errors from variations in the thickness of the belt 32, eccentricities in the drive roller 34 and idle roller 36, and gear train transmission errors, among others. A representative number of pulse counts per revolution is 1800 lines per revolution. The encoder 56 is preferably mounted on a shaft of the wheel 54 so as to rotate along with the wheel. In the exemplary embodiment, the housing for encoder 56 is attached to a wall of the subassembly 12, in order to maintain wheel 54 in position along the pathway of belt 32. However, other attachment arrangements may also be utilized to maintain wheel 54 in the appropriate position, depending upon the application, without departing from the scope of the invention. Preferably, the eccentricity of wheel 54, and its mounting to the encoder 56 and subassembly 12 is within a reasonable tolerance such as, for example, 10 microns, to maintain print quality within the apparatus. As indicated by arrow 60, the pulse signal from encoder 56 is provided as a feedback signal to the motor controller 46 to enable the motor controller to adjust the drive motor 42 in conjunction with the measured motion, as will be described in more detail below.

In order for wheel 54 to accurately measure the surface motion of the belt 32, the wheel is designed such that the wheel circumference is equal to, or is an integer multiple of, the linear distance between each of the transfer points 31Y, 31C, 31M, and 31K. This spacing enables any eccentricities introduced by the construction or mounting of the wheel 54 to be synchronous with the color plane spacing. Therefore, any errors occurring in one color plane will be repeated in all planes and will tend to be hidden. Thus, as shown in FIG. 1, the circumference of wheel 54 is preferably equal to or an integer multiple of the distance d, indicated by reference arrow 62.

Apparatus 10 also includes structure for compensating for changes in the size of wheel 54 as a result of environmental changes within the apparatus. As shown in FIG. 1, this compensating structure includes a temperature sensing device such as, for example, a thermistor 66, for measuring the operating temperature within the ITM subassembly 12. The thermistor 66 is placed at a known point in the subassembly 12, preferably near the wheel 54, in order to detect temperature changes affecting the wheel. When the thermistor 66 detects a temperature change, the change is communicated to the print machine controller 50, as indicated by arrow 68. The controller 50 then issues an appropriate motor velocity command to the motor controller 46, as indicated by arrow 64, to adjust the speed of the drive motor 42 to account for the temperature change. Additionally, an encoder frequency verses machine temperature "map" is generated at the time of manufacture of the ITM subassembly 12, and is stored in a memory associated with the print machine controller 50. The map may be developed through calculations and experiments that determine how temperature changes within the ITM subassembly 12 affect the speed of the transfer belt 32. This map is used to provide an appropriate adjustment to the drive motor 42 to correspond to temperature changes in the apparatus 10.

For example, an increase in temperature within the ITM subassembly 12, such as might occur during a prolonged period of operation, will likely cause the wheel 54 to thermally expand. This thermal expansion will result in a change in the effective radius and circumference of the wheel 54. Since the encoder 56 rotates with the wheel 54, a change in the effective circumference of the wheel will effect the number of encoder pulses produced per revolution of the wheel. Thus, the thermal expansion of the wheel 54 will cause the number of encoder pulses generated to inaccurately represent the true velocity of the transfer belt 32. Using input from the thermistor 66, and the machine temperature verses encoder frequency map, print machine controller 50 can signal motor controller 46 of the need to adjust the speed of drive motor 42 to account for the difference in encoder pulse counts. Thus, the apparatus 10 can compensate for thermal changes affecting the wheel 54, and thereby maintain print quality regardless of machine temperature.

As mentioned above, the drive roller motor 42 is controlled by a motor controller 46. The motor controller 46 may be of a number of different types conventionally utilized in conjunction with ITM subassemblies, such as, for example, a PID velocity regulator, a phase-locked loop, or the like. In the preferred embodiment of the present invention, the motor controller 46 is a phase-locked loop (PLL) that adjusts the speed of the drive motor 42 based upon a comparison between the measured motion of the transfer belt 32 and a reference signal. Any error between the measured belt motion and the reference signal is communicated to the drive motor 42 to adjust the speed of the drive roller 34 and, thus, the transfer belt 32, until the feedback pulse signal from the encoder 56 matches the reference signal in frequency and phase. In the exemplary embodiment, the reference signal is a square wave signal provided to the controller 46 by machine controller 50, as indicated by arrow 64 in FIG. 1. The reference signal is the "commanded" signal for the PLL, which is compared to the feedback signal from the encoder 56, which is also a square wave signal. The reference signal from the machine controller 50 represents the desired velocity and position verses time for the transfer belt 32. Accordingly, the speed of the transfer belt 32 in any particular application may be set through the selection of the reference signal frequency.

Figure 2A:
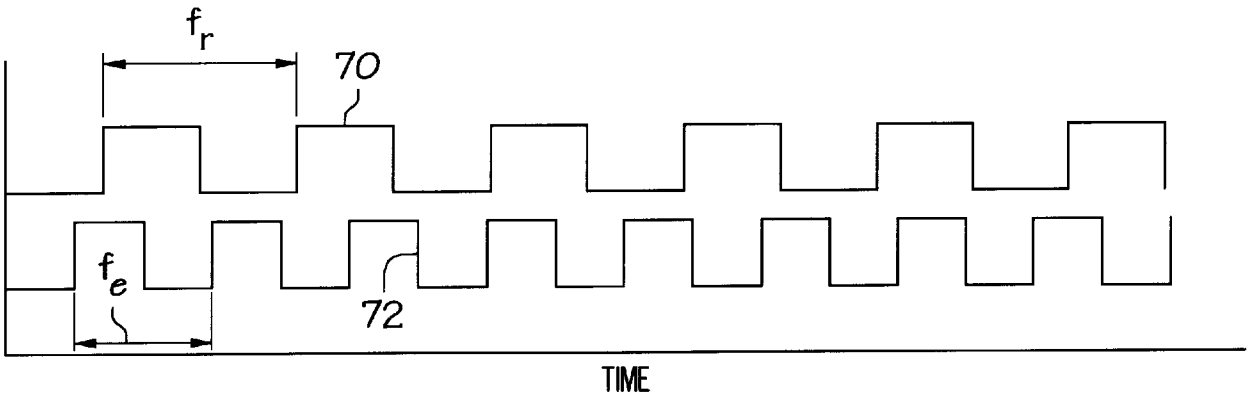
FIG. 2*a* is a graphical comparison between the reference signal applied to the motor controller and the encoder feedback signal in which the signals are not locked.
Figure 2B:
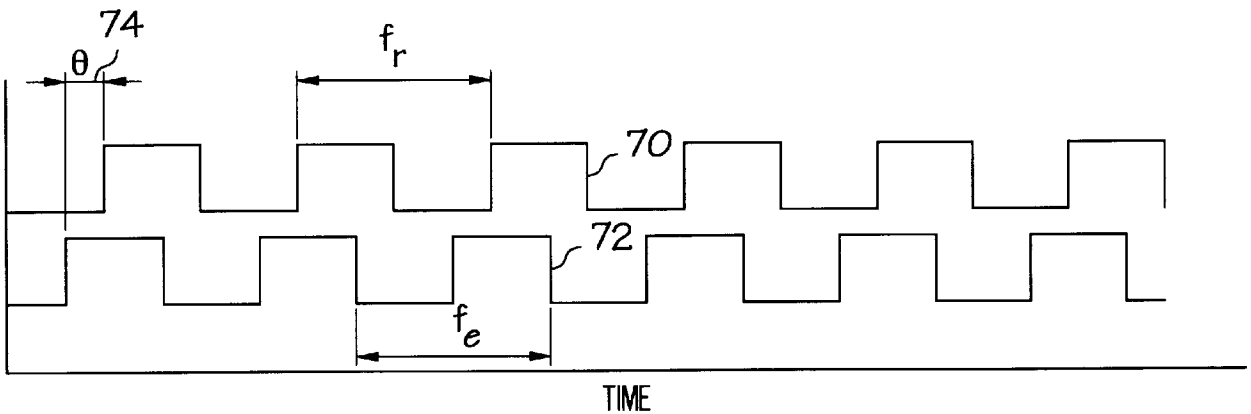
FIG. 2*b* is a graphical comparison similar to FIG. 2*a*, in which the reference and encoder signals are locked.

FIGS. 2*a* and 2*b* depict representative reference signals 70 and encoder pulse signals 72 for the motion quality system of the present invention. In the example shown in FIG. 2*a*, the frequency of the reference signal 70 (denoted by line $f_r$) is not equal to the frequency of the encoder pulse signal 72 (denoted by line $f_e$). Further, the phase relationship between the signals is not defined, since for each period the relative locations of the signal edges is random. Accordingly, for the situation shown in FIG. 2*a*, an appropriate motor voltage signal corresponding to the difference in frequency and phase between the signals would be applied to drive motor 42 to alter the speed of the motor and, correspondingly, the transfer belt 32.

FIG. 2*b* depicts the desired situation for the present invention, in which the motor controller 46 has applied an appropriate motor voltage to the drive motor 42, based upon the signal comparison in the PLL, to adjust the speed of the belt 32 so that the frequency $f_e$ of the encoder feedback signal 72 matches the reference signal frequency $f_r$, thus "locking" the signals. The two signals shown in FIG. 2*b* are considered locked even though there is a phase difference θ, identified by reference numeral 74, between the signals, since the phase difference is constant for every period of the reference signal. Any phase and frequency errors between the reference and feedback signals 70, 72 may be filtered so that the dynamic response of the drive motor 42 meets desired specifications. While the two signals are locked, the drive motor 42 rotates the transfer belt 32 so that the effective surface velocity of the belt is a constant.

As mentioned above, the encoder feedback signal 72 is generated by the ITM belt motion rotating the surface wheel 54 and attached encoder 56. Thus, the frequency of the encoder feedback signal 72 is proportional to the linear velocity of the ITM belt, and may be defined by the equation:

$$f_e = \frac{vN}{2\pi r} \tag{1}$$

where:

$f_e$=surface wheel encoder frequency, Hz v=belt velocity, mm/s

N=number of encoder cycles per revolution of the surface wheel r=effective radius of the surface wheel, mm.

When the two signals 70, 72 are locked, as in FIG. 2*b*, the encoder feedback signal is equal to the reference signal. Accordingly, equation (1) may be utilized to determine the desired frequency for the reference signal 70 from the desired belt velocity for the ITM, the number of encoder cycles per revolution, and the size of the surface wheel 54. The reference clock signal from the print engine controller 50 may then be set using the above equation.

Figure 3:
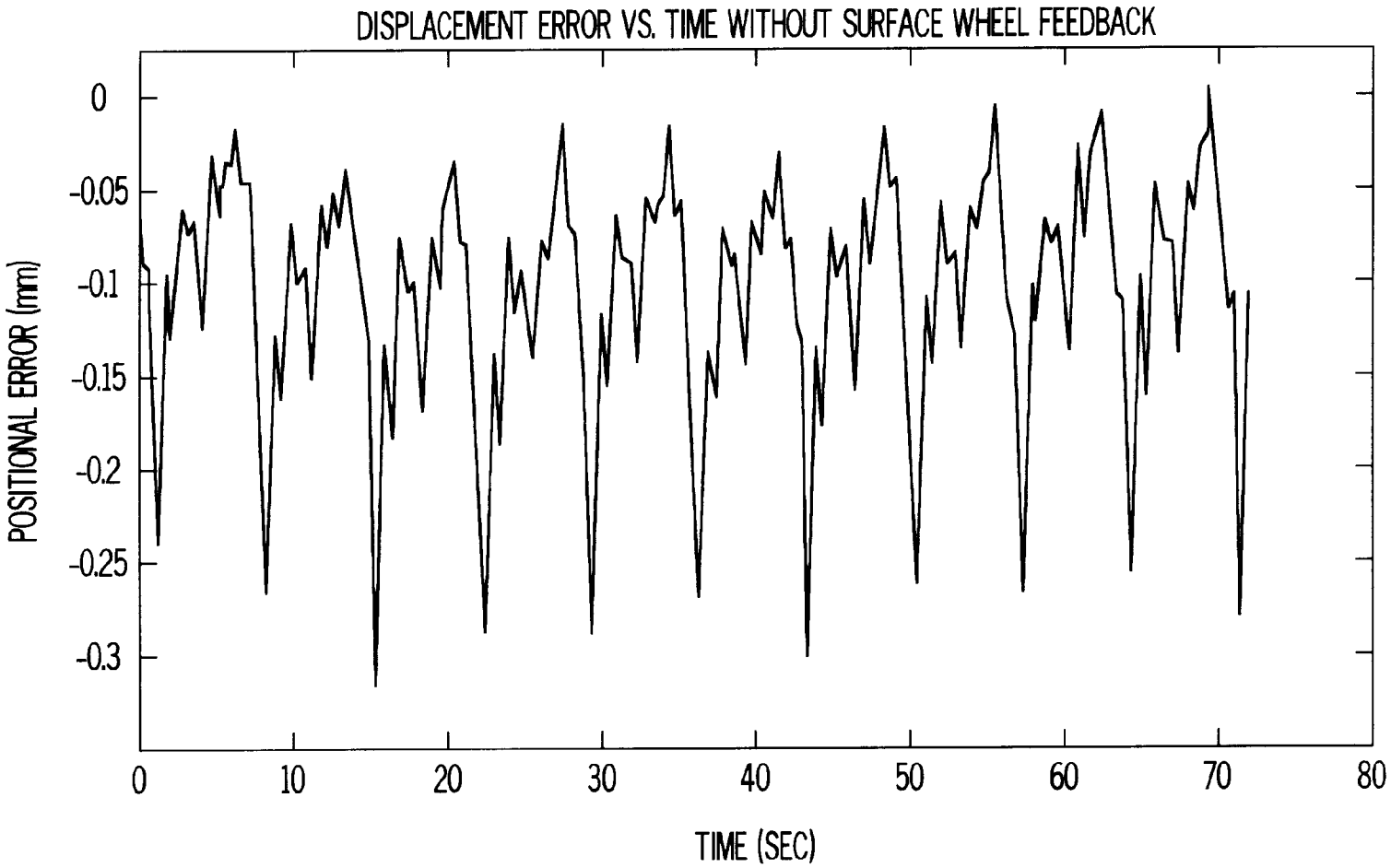
FIG. 3 is an intermediate transfer member displacement error verses time profile for an intermediate transfer member assembly without the surface wheel feedback of the present invention.
Figure 4:
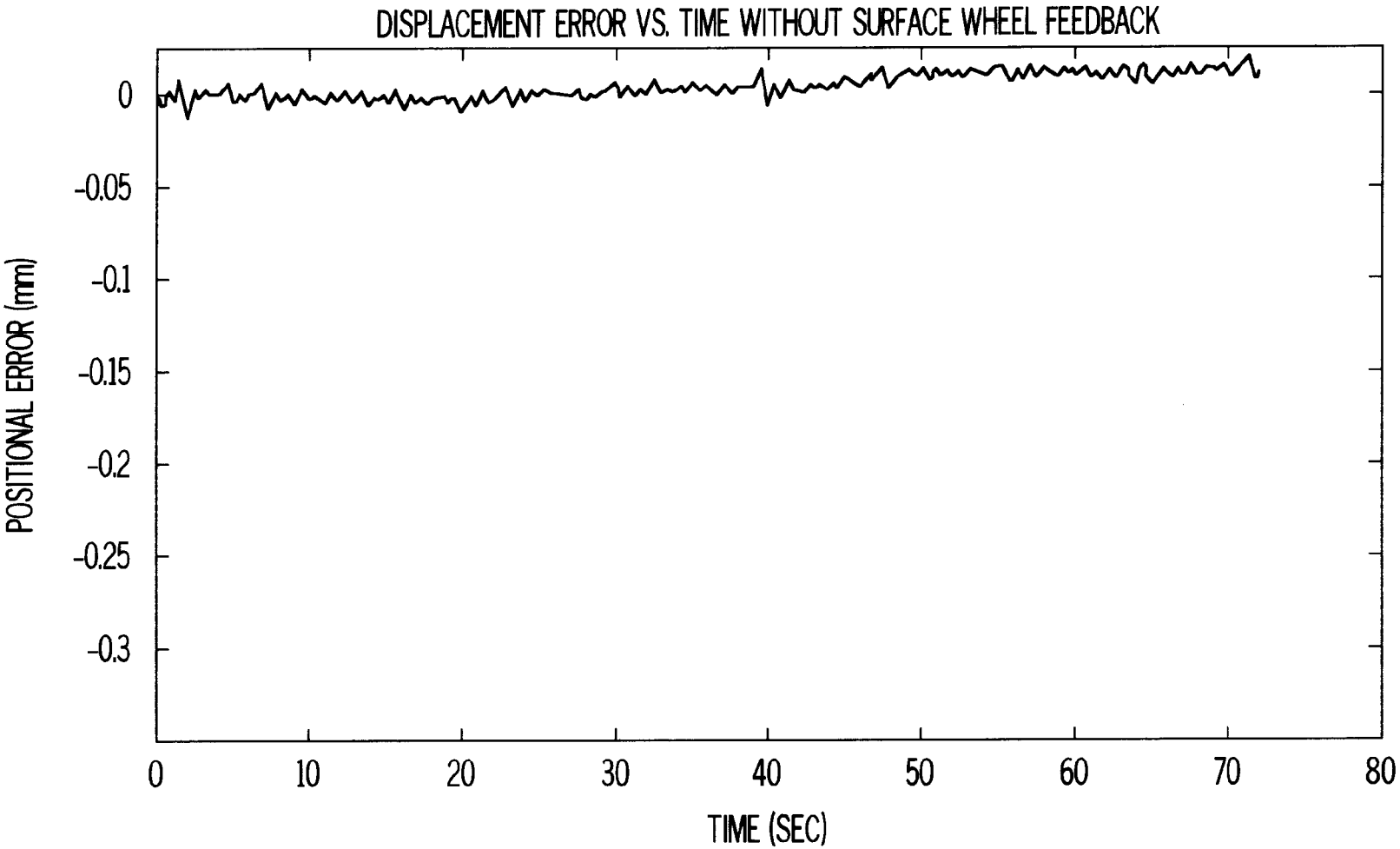
FIG. 4 is a profile similar to FIG. 3, depicting the intermediate transfer member displacement error verses time for an intermediate transfer member assembly with the surface wheel feedback of the present invention.
Figure 5:
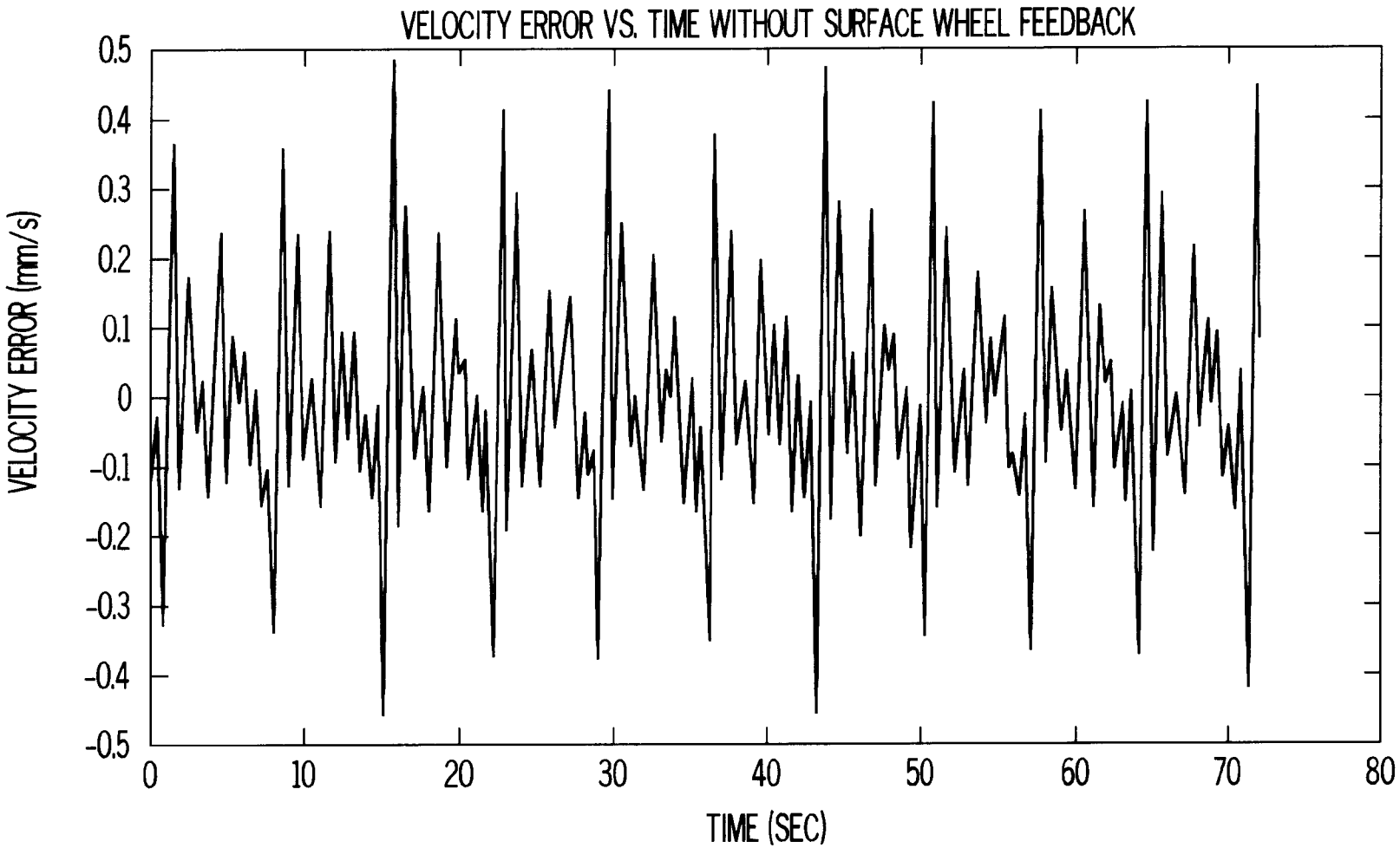
FIG. 5 is an intermediate transfer member velocity error verses time profile for an intermediate transfer member assembly without the surface wheel feedback of the present invention.
Figure 6:
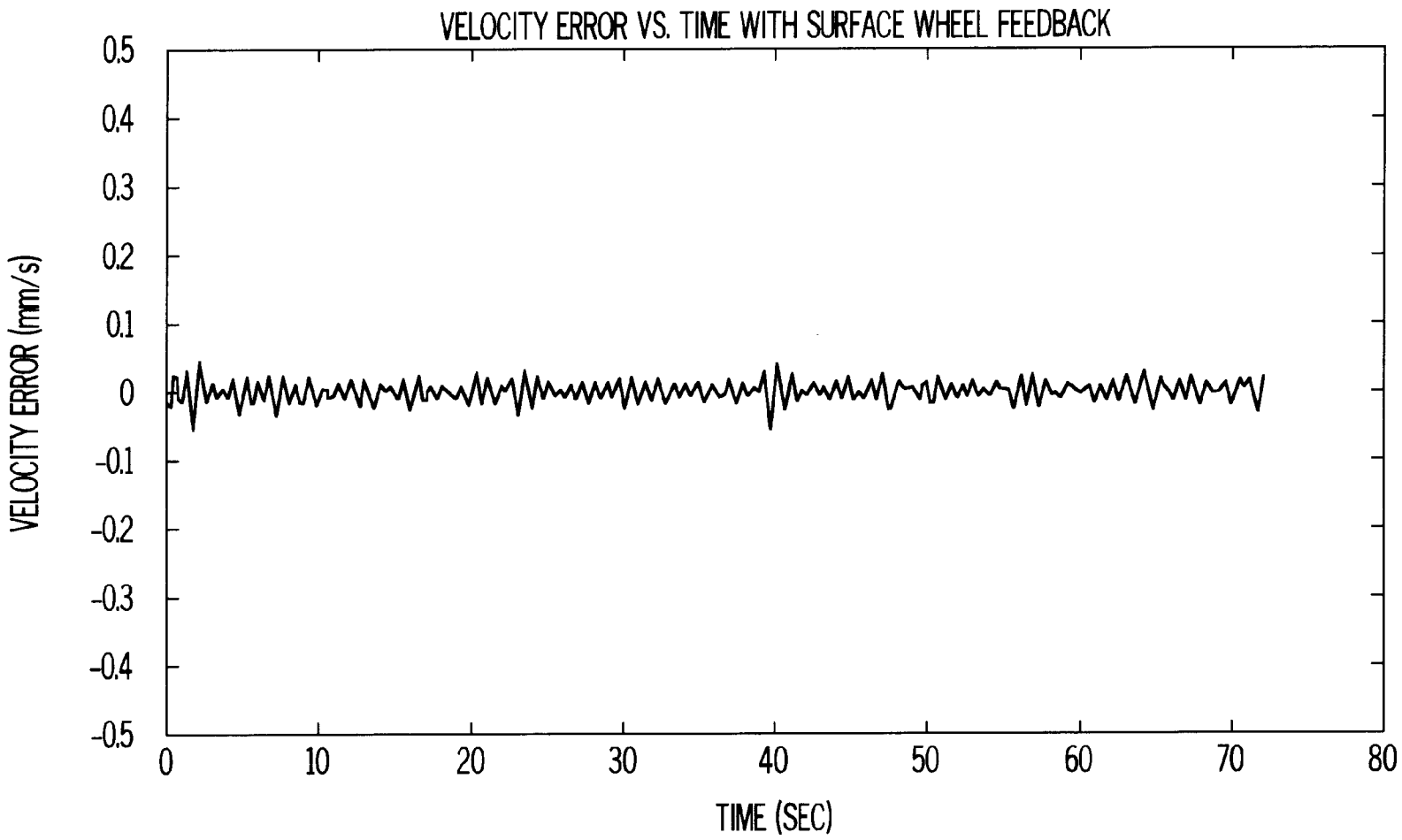
FIG. 6 is a profile similar to FIG. 5, depicting the intermediate transfer member velocity error profile for an intermediate transfer member assembly with the surface wheel feedback of the present invention.

A demonstration of an exemplary embodiment of the present invention was performed on laboratory equipment known as a "belt tracking robot" comprising all of the components depicted in FIG. 1, with the exception of the thermistor 66. In this demonstration, the ITM subassembly 12 was run in two modes. In the first mode, the ITM subassembly 12 was operated without the surface wheel 54 of the present invention, such that the drive motor 42 was run at a constant speed based only upon feedback from an encoder on the motor 42 itself. In the second mode, the ITM subassembly 12 was operated using the surface wheel 54 of the present invention to directly measure the surface motion of the transfer belt 32, and provide feedback regarding the motion of the belt to the drive motor 42. FIGS. 3 and 4 illustrate the difference in displacement error verses time obtainable from using the surface wheel 54 of the present invention. FIG. 3 illustrates the positional variations in the first mode without the wheel 54, while FIG. 4 illustrates the reduction in positional variations obtainable with the wheel. Likewise, FIGS. 5 and 6 illustrate the difference in velocity error verses time for the transfer belt 32 for the two different modes; the first mode without the surface wheel and encoder feedback signal, and the second mode with the benefit of the encoder feedback signal. As evidenced by the profiles, both the positional and velocity errors of the transfer belt 32 were significantly reduced by directly measuring the surface motion of the transfer belt itself in addition to the drive motor speed at the motor.

Figure 7:
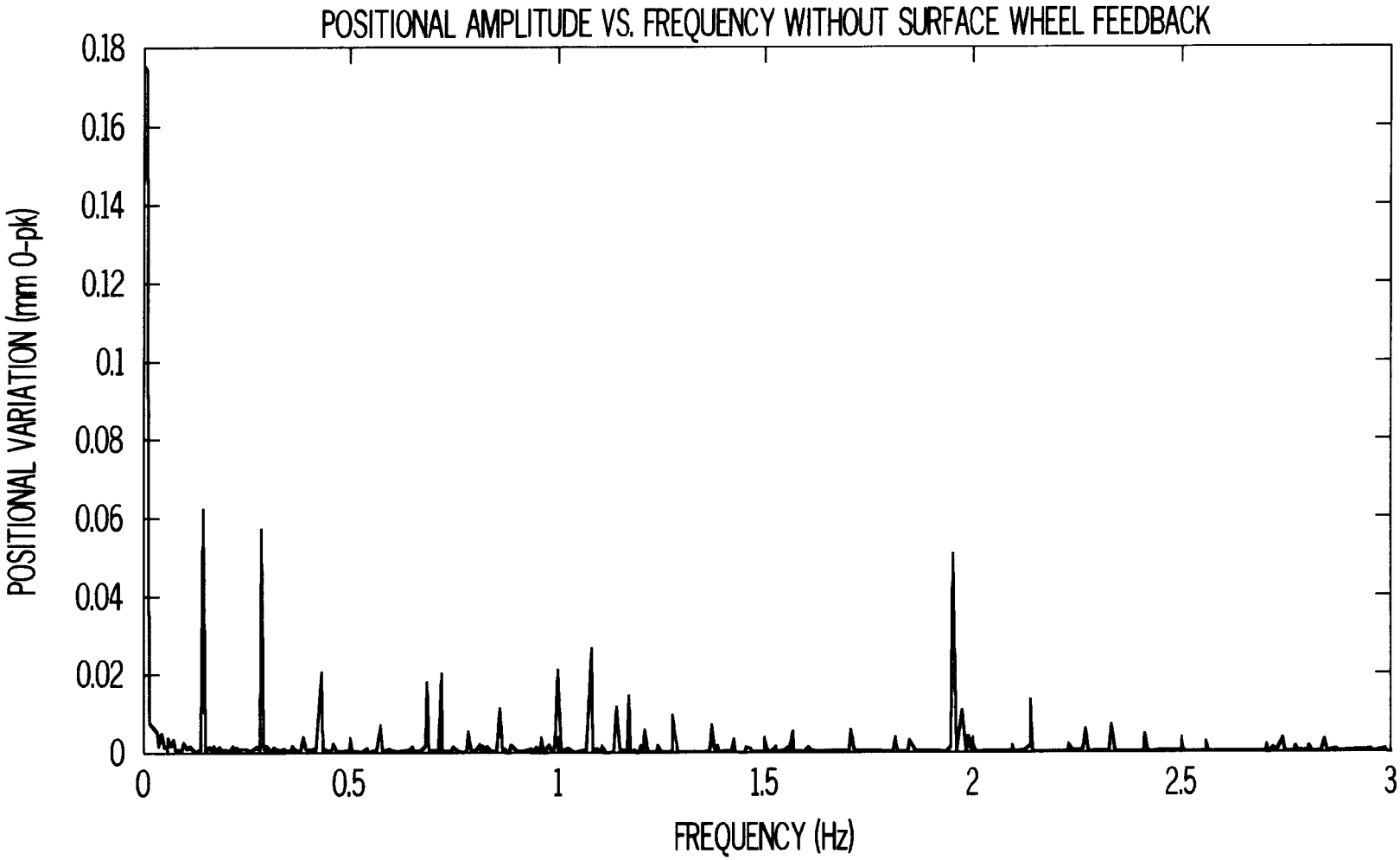
FIG. 7 is a positional amplitude verses frequency profile for an intermediate transfer member assembly without the surface wheel feedback of the present invention.
Figure 8:
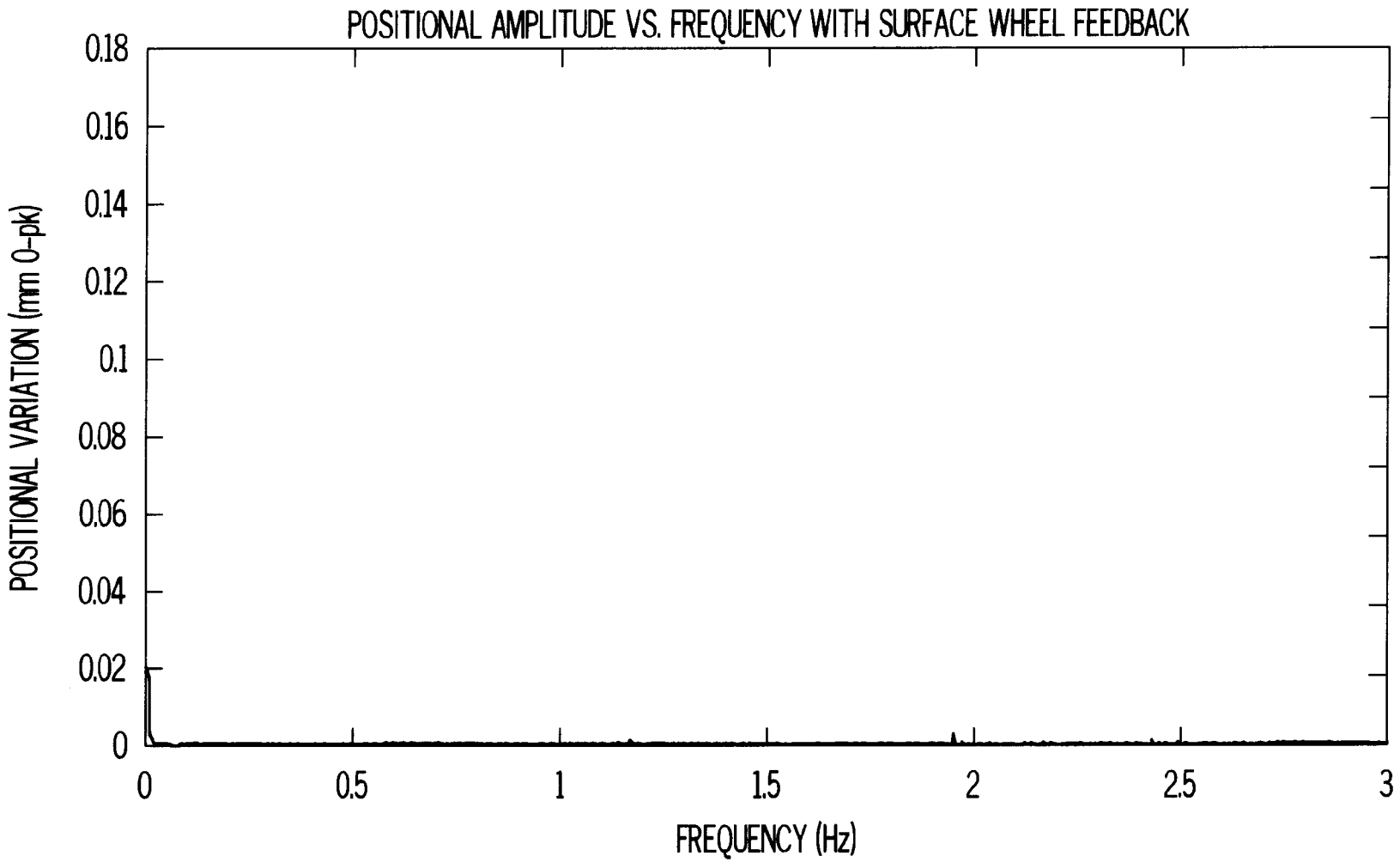
FIG. 8 is a profile similar to FIG. 7, depicting the positional amplitude verses frequency profile for an intermediate transfer member assembly with the surface wheel feedback of the present invention.

Finally, FIGS. 7 and 8 illustrate the frequency spectrum of the positional errors for the two different operating modes. FIG. 7 illustrates the first mode without the surface wheel 54, and FIG. 8 depicts the second mode with the surface wheel and encoder feedback signal. As shown in FIG. 8, utilizing the surface wheel and encoder feedback signal of the present invention significantly reduces positional errors in the transfer belt 32 throughout a range of frequencies. Thus, the present invention can account for positional errors due to a number of different component eccentricities and adjust the speed of the transfer belt for each of these eccentricities directly, thereby maintaining a more constant belt velocity and, thus, better print quality.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A motion control system for controlling the motion of an intermediate transfer member in an image forming apparatus, said motion control system comprising:

a drive motor and associated drive roller for rotating said intermediate transfer member;

a measuring member in contact with said intermediate transfer member for generating a signal proportional to the velocity of said intermediate transfer member, wherein the measuring member comprises a wheel rotating in contact with said intermediate transfer member, and further wherein the measuring member comprises an encoder rotating with said wheel for generating a series of pulses at a rate proportional to the velocity of said intermediate transfer member; and a motor controller for receiving said signal and adjusting the speed of said drive motor in accordance with said signal.

2. The motion control system of claim 1, wherein said measuring member is in contact with a surface of said intermediate transfer member for directly measuring the surface motion of said intermediate transfer member.

3. The motion control system of claim 1, wherein said wheel is passively rotated by said intermediate transfer member.

4. The motion control system of claim 1, wherein a circumference of said wheel contacts a surface of said intermediate transfer member to rotate said wheel in conjunction with the motion of said intermediate transfer member.

5. The motion control system of claim 1, wherein said encoder pulses are applied as a feedback signal to said motor controller.

6. The motion control system of claim 5, wherein said motor controller compares said feedback signal with a reference signal, and adjusts the speed of said drive motor based on a difference between said signals.

7. The motion control system of claim 5, wherein said motor controller comprises a phase-locked loop.

8. The motion control system of claim 1, wherein said system further comprises structure for adjusting said drive motor speed to compensate for environmental changes in said apparatus.

9. A motion control system for controlling the motion of an intermediate transfer member in an image forming apparatus, said motion control system comprising:

a drive motor and associated drive roller for rotating said intermediate transfer member;

a measuring member in contact with said intermediate transfer member for generating a signal proportional to the measured motion of said intermediate transfer member, wherein the measuring member comprises a rotation member rotating in contact with said intermediate transfer member, and further wherein the measuring member comprises an encoder rotating with said rotation member for generating a series of pulses at a rate proportional to the measured motion of said intermediate transfer member; and a motor controller for receiving said signal and adjusting the speed of said drive motor in accordance with said signal.

10. The motion control system of claim 9, wherein the rotational member comprises a wheel rotating in contact with said intermediate transfer member.

11. The motion control system of claim 10, wherein a circumference of said wheel contacts a surface of said intermediate transfer member to rotate said wheel in conjunction with the motion of said intermediate transfer member.

12. The motion control system of claim 9, wherein said encoder pulses are applied as a feedback signal to said motor controller.

13. The motion control system of claim 12, wherein said motion controller compares said feedback signal with a reference signal, and adjusts the speed of said drive motor based on a difference between said signals.

14. The motion control system of claim 12, wherein said motor controller comprises a phase-locked loop.

15. The motion control system of claim 9, wherein said system further comprises structure for adjusting said drive motor speed to compensate for environmental changes in said apparatus.

16. The motion control system of claim 9, wherein said rotational member is passively rotated by said intermediate transfer member.

17. A method of controlling the motion of an intermediate transfer member in an image forming apparatus, said method comprising the steps of:

directly measuring a surface motion of said intermediate transfer member;

providing said measured surface motion as a feedback signal to a motor controller for said intermediate transfer member; and adjusting the velocity of said intermediate transfer member in accordance with said feedback signal; wherein said measuring step further comprises rotating a measuring member in contact with a surface of said intermediate transfer member to generate said feedback signal, and further wherein said measuring step further comprises rotating a wheel and attached encoder on a surface of said intermediate transfer member to generate encoder pulses corresponding to the surface motion of said intermediate transfer member.

18. The method of claim 17, wherein said providing step further comprises applying said encoder pulses to said motor controller as a feedback signal.

19. The method of claim 18, wherein said adjusting step further comprises comparing said feedback signal with a reference signal and adjusting the velocity of said intermediate transfer member in accordance with a difference between said signals.

20. The method of claim 17, further comprising the steps of measuring a temperature in said image forming apparatus and adjusting said intermediate transfer member velocity to compensate for thermal effects on said measured surface motion.

21. A method of controlling the motion of an intermediate transfer member in an image forming apparatus, said method comprising the steps of:

directly measuring a surface motion of said intermediate transfer member;

providing said measured surface motion as a feedback signal to a motor controller for said intermediate transfer member; and adjusting the motion of said intermediate transfer member in accordance with said feedback signal; wherein said measuring step further comprises rotating a rotational member and attached encoder on a surface of said intermediate transfer member to generate encoder pulses corresponding to the surface motion of said intermediate transfer member.

22. The method of claim 21, wherein said providing step further comprises applying said encoder pulses to said motor controller as a feedback signal.

23. The method of claim 22, wherein said adjusting step further comprises comparing said feedback signal with a reference signal and adjusting the motion of said intermediate transfer member in accordance with a difference between said signals.

24. The method of claim 21, further comprising the steps measuring a temperature in said image forming apparatus and adjusting said intermediate transfer member motion to compensate for thermal effects on said measured surface motion.

25. A color image forming apparatus for forming an image by superposing a plurality of color planes on a transfer media, said apparatus comprising:

one or more image forming members for forming a plurality of different color toner images;

an intermediate transfer member for receiving each of said different color toner images at a transfer point;

a drive member for rotating said intermediate transfer member; and a measuring member for directly measuring motion on a surface of said intermediate transfer member and controlling said drive member in accordance with said measure motion, wherein the measuring member comprises a wheel rotating on the surface of said intermediate transfer member, and further comprises an encoder rotating with said wheel for generating pulses proportional to the motion of said intermediate transfer member.

26. The apparatus of claim 25, wherein said apparatus comprises a plurality of transfer points spaced along said intermediate transfer member, and wherein the spacing between transfer points is an integer multiple of the circumference of said wheel.

27. The apparatus of claim 25, further comprising a motor controller for receiving a pulse signal from said encoder, comparing said pulse signal with a reference signal, and adjusting the speed of said drive member based upon a difference between said signals.

28. The apparatus of claim 25, wherein said apparatus further comprises structure for adjusting the speed of said drive member to compensate for thermal effects on said measuring member.

29. A color image forming apparatus for forming an image by superposing a plurality of color planes on a transfer media, said apparatus comprising:

one or more image forming members for forming a plurality of different color toner images;

an intermediate transfer member for receiving each of said different color toner images at a transfer point;

a drive member for rotating said intermediate transfer member; and a measuring member for directly measuring motion on a surface of said intermediate transfer member and controlling said drive member in accordance with said measure motion, wherein the measuring member comprises a rotational member rotating on the surface of said intermediate transfer member, and further comprises an encoder rotating with said rotational member for generating pulses proportional to the motion of said intermediate transfer member.

30. The apparatus of claim 29, wherein said apparatus comprises a plurality of transfer points spaced along said intermediate transfer member, and wherein the spacing between transfer points is an integer multiple of the circumference of said rotational member.

31. The apparatus of claim 30, further comprising a motor controller for receiving a pulse signal from said encoder, comparing said pulse signal with a reference signal, and adjusting the speed of said drive member based upon a difference between said signals.

32. The apparatus of claim 29, wherein said apparatus further comprises structure for adjusting the speed of said drive member to compensate for thermal effects on said measuring member.

* * * * *